United States Patent [19]

Hanafusa et al.

[11] Patent Number: 4,762,111

[45] Date of Patent: Aug. 9, 1988

[54] HEAD COVER ARRANGEMENT FOR DOUBLE OVERHEAD CAM TYPE ENGINE

[75] Inventors: Hiroyuki Hanafusa, Hiroshima; Fusatoshi Tanaka, Higashihiroshima; Hideo Nakayama; Shuichi Nakatani, both of Hiroshima, all of Japan

[73] Assignee: Mazda Motor Corporation, Hiroshima, Japan

[21] Appl. No.: 888,955

[22] Filed: Jul. 24, 1986

[30] Foreign Application Priority Data

Jul. 25, 1985 [JP] Japan ..... 60-114927[U]

[51] Int. Cl.[4] ..... F02B 77/00

[52] U.S. Cl. ..... 123/647; 123/198 E

[58] Field of Search ..... 123/195 A, 195 C, 195 E, 123/198 E, 647

[56] References Cited

U.S. PATENT DOCUMENTS

| | | | |
|---|---|---|---|
| 2,474,510 | 6/1949 | Arthur | 123/195 E |
| 2,533,487 | 12/1950 | Maurer et al. | 123/195 E |
| 3,020,707 | 2/1962 | Post et al. | 123/198 E |
| 4,515,141 | 5/1985 | Bergsten et al. | 123/198 E |
| 4,587,935 | 5/1986 | Yamazaki | 123/198 E |

FOREIGN PATENT DOCUMENTS 143128 8/1983 Japan .

OTHER PUBLICATIONS

*The Honda T360 Service Manual*, published 7/66, by Honda Giken Kogyo Kabushiki Kaisha, Tokyo, Japan.

Ford Motor Co.; 1/1972; Truck Shop Manual–vol. II engine.

*Primary Examiner*—Charles J. Myhre

*Assistant Examiner*—David A. Okonsky

*Attorney, Agent, or Firm*—Burns, Doane, Swecker & Mathis

[57] ABSTRACT

A head cover arrangement for a double overhead cam type engine, including a head cover for covering two cam shafts provided, in parallel with each other, on a cylinder head and a boundary member for bounding a hollow defined, between the cam shafts, by the head cover and the cylinder head so as to form a chamber for accommodating a plurality of spark plugs and a plurality of high-tension cords connected to the spark plugs, respectively. The boundary member includes an upper member for constituting a top wall of the chamber and a side member for constituting a side wall of the chamber and the side member is formed with a plurality of recesses for securing the high-tension cords, respectively such that the high-tension cords are drawn out of the chamber through the recesses, respectively.

15 Claims, 5 Drawing Sheets

HEAD COVER ARRANGEMENT FOR DOUBLE OVERHEAD CAM TYPE ENGINE

BACKGROUND OF THE INVENTION

The present invention generally relates to a double overhead cam (referred to as "DOHC", hereinbelow) type engine having a spark plug provided in a hollow between a pair of head covers and more particularly, to a head cover arrangement for the DOHC engine, in which a lid is provided between the head covers so as to prevent penetration of rain water, dust, etc. into a plug hole for the spark plug.

Conventionally, in DOHC type engines, it has been generally so arranged that a pair of cam shafts are provided at an upper portion of a cylinder head so as to be disposed at opposite positions relative to a longitudinal centerline of the engine and head covers are, respectively, provided above the cam shafts. In the known cylinder head of the above described arrangement, a groove is formed between the opposite head covers and a spark plug is provided in the groove so as to be fitted into a plug hole of the cylinder head. In order to prevent penetration of rain water, dust, etc. into the groove, a cover is, for example, provided at an upper portion of the groove as disclosed by Japanese Patent Laid-Open Publication No. 143128/1983.

However, the known cylinder head of the above described arrangement has such an inconvenience that since a high-tension cord connected to the spark plug is passed through a bore of the above described cover provided at the upper portion of the groove so as to be drawn upwardly from the cover, penetration of rain water, etc. into the plug hole may readily take place if sealing of the bore becomes loose.

Furthermore, in order to mount the cover in the known cylinder head, it is necessary to connect the high-tension cord to the spark plug after the high-tension cord has been passed through the bore of the cover and then, mount the cover in position. Thus, the known cylinder head has such a drawback that assembly and disassembly of the cover cannot be performed efficiently.

SUMMARY OF THE INVENTION

Accordingly, an essential object of the present invention is to provide a head cover arrangement for a DOHC type engine, which can be assembled or disassembled efficiently, with substantial elimination of the disadvantages inherent in conventional head cover arrangements of this kind.

Another important object of the present invention is to provide a head cover arrangement of the above described type, in which an outlet of a high-tension cord is sealed tightly such that penetration of rain water, dust, etc. into a plug hole for a spark plug can be prevented positively.

In order to accomplish these objects of the present invention, a head cover arrangement for a double overhead cam type engine embodying the present invention includes a head cover for covering two cam shafts provided, in parallel with each other, on a cylinder head such that a plurality of spark plugs are provided in a hollow defined, between said cam shafts, by an outer peripheral face of said head cover and an outer peripheral face of said cylinder head, the improvement comprising: a boundary member for bounding the hollow so as to form a chamber for accommodating therein said spark plugs and a plurality of high-tension cords connected to said spark plugs, respectively; said boundary member including an upper member and a side member; said upper member being mounted on said head cover and extending in an axial direction of said cam shafts so as to constitute a top wall of the chamber; said side member being provided at one end of said upper member in the axial direction of said cam shafts so as to constitute a side wall of the chamber and being formed, at its edge portion abutting on said upper member, with a plurality of recesses for securing therein said high-tension cords, respectively such that said high-tension cords are drawn out of the chamber through the recesses, respectively.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
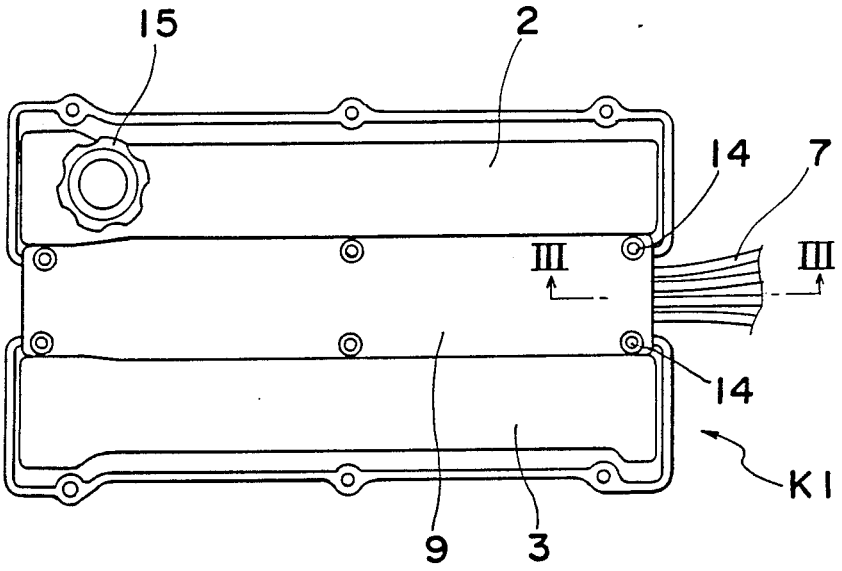
FIG. 1 is a top plan view of a head cover arrangement for a DOHC type engine, according to a first embodiment of the present invention.
Figure 2:
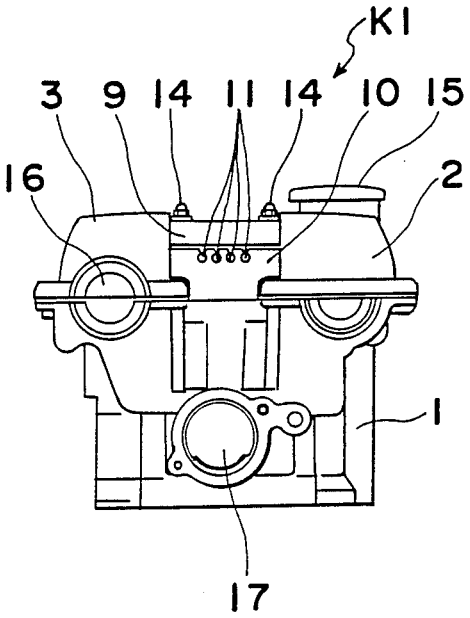
FIG. 2 is a side elevational view of the head cover arrangement of FIG. 1.
Figure 3:
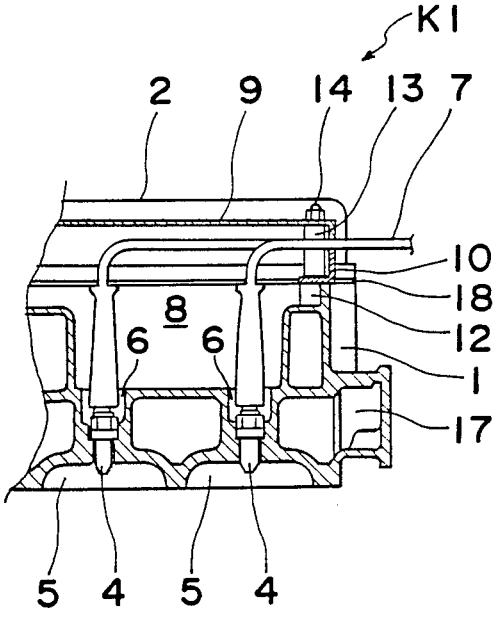
FIG. 3 is a sectional view taken along the line III—III in FIG. 1.

Referring now to the drawings, there is shown in FIGS. 1 to 3, a head cover arrangement K1 for a DOHC type engine, according to a first embodiment of the present invention. The DOHC type engine is equipped with a plurality of, for example, four cylinders. As shown in FIGS. 1 to 3, there are provided head covers 2 and 3 for covering a plurality of cam shafts (not shown) mounted on a cylinder head 1. A plurality of spark plugs 4 for the respective cylinders are provided in a groove between the head covers 2 and 3. In the cylinder head 1, each of the cylinders is formed with a combustion chamber 5 and a plug hole 6. Each of the spark plugs 4 is fitted into the plug hole 6 from above the cylinder head 1 so as to confront the combustion chamber 5.

Furthermore, an upper plate 9 and a pair of lower plates 10 are provided so as to define between the head covers 2 and 3 a chamber 8 for accommodating therein the spark plugs 4 and a plurality of high-tension cords 7 connected to the spark plugs 4, respectively. The upper plate 9 has a length slightly larger than the head covers 2 and 3 and has a substantially inverse U shape in its longitudinal section. Meanwhile, the lower plates 10 are disposed at opposite end of the upper plate 9. Each of the lower plates 10 has a width corresponding to a distance between the head covers 2 and 3 and has an L-shaped section. One of the lower plates 10 is formed with a plurality of recesses 11 for securing therein the high-tension cords 7. It is to be noted that the lower plates 10 are made of insulating material such as synthetic resin so as to prevent electrical leak from the high-tension cords 7. Contact portions between the upper plate 9 and the head covers 2 and 3 in the longitudinal direction of the upper plate 9 is sealed. Meanwhile, contact portions between bent portions of the opposite ends of the upper plate 9 and the head covers 9 and 10 are sealed. Furthermore, contact portions between the lower plates 10 and the head covers 2 and 3 are sealed. Moreover, the bent portions of the opposite ends of the upper plate 9 and upper edges of the lower plates 10 are butted against each other so as to be sealed.

The cylinder head 1 is formed with boss portions 12 for the lower plates 10 and boss portions 13 for the upper plate 9. The lower plates 10 and the upper plate 9 are secured to the cylinder head 1 through the boss portions 12 and 13 by bolts 14. Meanwhile, the head cover 2 is formed with an oil inlet having a cap 15. The head cover 3 is formed, at its one end, with an opening 16 for mounting therein a distributor. In addition, a cooling water passage 17 for circulating cooling water therethrough is provided in the cylinder head 1 so as to be communicated with a radiator (not shown).

By the above described arrangement of the head cover arrangement K1, the upper plate 9 and the lower plates 10 are mounted on the cylinder head 1 as follows. Each of the spark plugs 4 is fitted into the plug hole 6 and then, each of the high-tension cords 7 is connected to each of the spark plugs 4. Subsequently, the high-tension cords 7 are fitted into the recesses 11 of one of the lower plates 10, respectively. Then, when a lower edge of each of the bent portions of the opposite ends of the upper plate 9 is brought into contact with the upper edge of each of the lower plates 10, the upper plate 9 and the lower plates 10 are secured to the cylinder head 1 by the bolts 14. Thus, the high-tension cords 7 interposed between the lower plates 10 and the upper plate 9 are retained in the recesses 11 so as to be drawn outwardly from the cylinder head 1. Accordingly, in an operation for connecting the high-tension cords 7 to the spark plugs 4, respectively in the present invention, such an inconvenience associated with the conventional head cover arrangement is eliminated that the high-tension cords 7 are required to be connected to the spark plugs 4 after each of the high-tension cords 7 has been passed through the bore of the cover as referred to earlier. Namely, in the present invention, the upper plate 9 and the lower plates 10 are mounted on the cylinder head 1 after the high-tension cords 7 have been connected to the spark plugs 4. Accordingly, the head cover arrangement K1 can be assembled or disassembled highly efficiently and maintenance of the head cover arrangement K1 can be performed remarkably easily.

Furthermore, in the present invention, since the outlets 11 of the high-tension cords 7 are provided at one end of the plates 9 and 10 for defining the chamber 8 accommodating therein the spark plugs 4 and the high-tension cords 7, penetration of rain water, dust, etc. into the head cover arrangement can be prevented more positively than the known head cover arrangement in which the high-tension cords are drawn upwardly from the cover. Moreover, in the present invention, the outlets 11 of the high-tension cords 7 can be sealed tightly.

Meanwhile, as shown in FIG. 3, a gasket 18 is provided between an upper face of the cylinder head 1 and the head covers 2 and 3. Although not specifically shown, proper sealing members may be provided at contact surfaces between the plates 9 and 10 and the head covers 2 and 3 so as to seal the head cover arrangement more tightly.

As is clear from the foregoing description, in the head cover arrangement of the present invention, the plate means split into the upper plate member and the lower plate member is provided between the head covers in the DOHC type engine having the spark plugs between the head covers and the mounting portions for securing thereto the high-tension cords are provided at the lower plate member. Thus, after the high-tension cords have been connected to the spark plugs, the high-tension cords can be secured to the mounting portions of the lower plate member so as to be drawn outwardly. Accordingly, in accordance with the present invention, the high-tension cords can be connected to the spark plugs quite efficiently, while the upper and lower plate members can be attached to or detached from the cylinder head remarkably efficiently and maintenance of the upper and lower plate members can be performed quite easily.

Furthermore, in accordance with the present invention, since the high-tension cords are not drawn upwardly out of the upper portion of the plate means, namely, the high-tension cords are drawn horizontally out of one end of the lower plate member, penetration of rain water, dust, etc. into the plug holes can be prevented positively and the outlets of the high-tension cords can be sealed tightly.

Moreover, in accordance with the present invention, since the lower plate member provided with the mounting portions for the high-tension cords is made of insulating material such as synthetic resin, electrical leak from the high-tension cords can be prevented securely.

Figure 4:
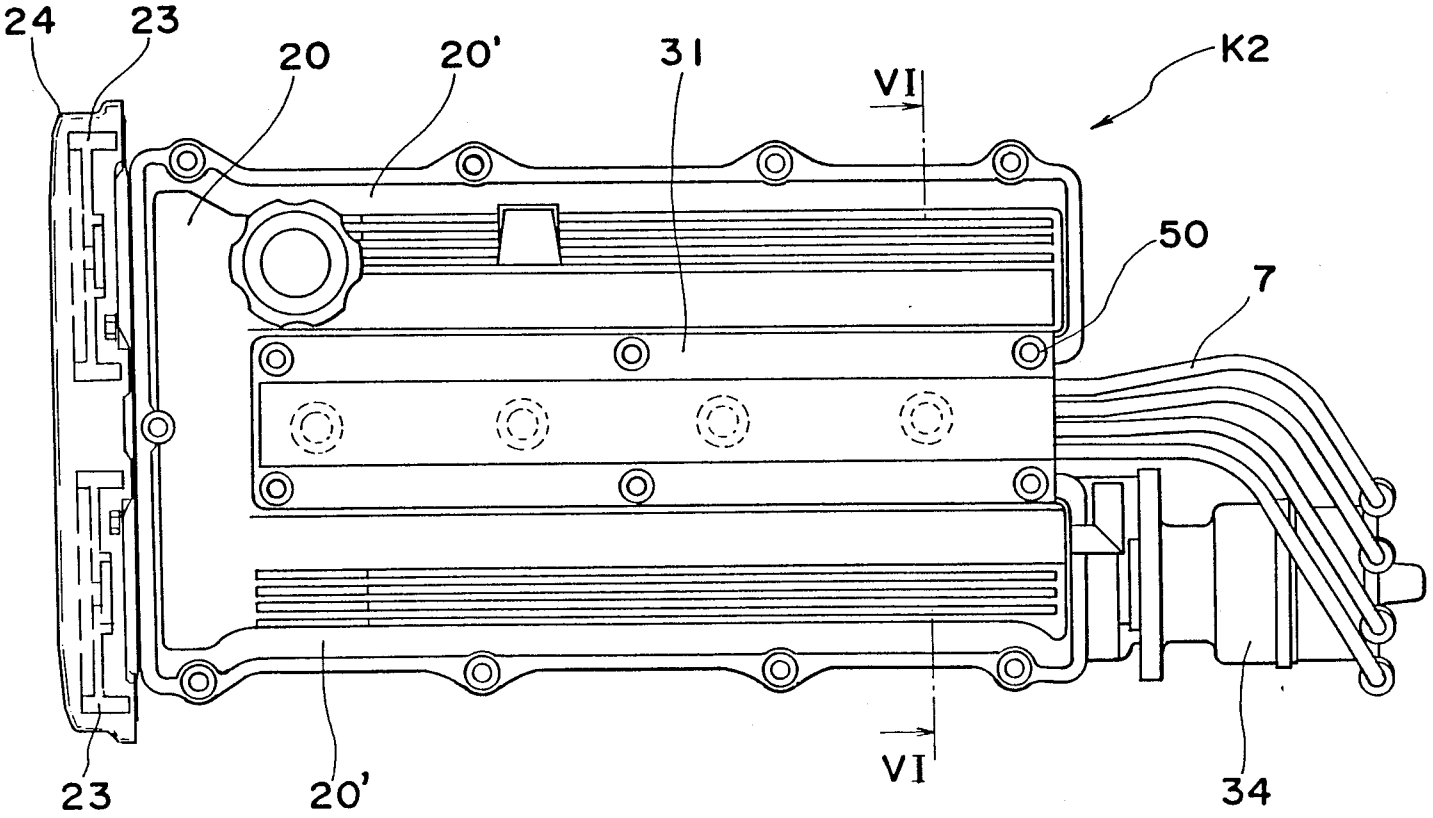
FIGS. 4 and 5 are views similar to FIGS. 1 and 2, respectively, particularly showing a second embodiment of the present invention.

Referring further to FIGS. 4 to 7, there is shown a head cover arrangement K2 according to a second embodiment of the present invention. In the head cover arrangement K2, the head covers 2 and 3 of the head cover arrangement K1 are replaced by a single head cover 20 made of light alloys such as aluminium alloy. Since the head cover 20 is made of light alloys, the head cover 20 is increased in rigidity so as to positively seal the chamber 8. The head cover 20 is obtained by coupling with each other a pair of cam shaft covers 20' for covering a pair of cam shafts 22, respectively. A partition wall 21 for dividing the chamber 8 into an upper chamber 8' and a lower chamber 8'' is integrally formed, between the cam shaft covers 20' with the head cover 20. Since the partition wall 21 is integrally formed with the head cover 20, the head cover 20 is increased in rigidity and the number of components of the head cover arrangement K2 is reduced. Furthermore, it is needless to say that the partition wall 21 is not required to be attached to or detached from the head cover 20. Since the partition wall 21 is mounted on the cylinder head 1 through packings 45 provided at a peripheral portion of the lower face of the partition wall 21, the lower chamber 8'' is positively sealed by the packings 45. An upper face portion of the partition wall 21 is made of light alloys. Thus, electrical leak from the high-tension cords 7 and wear of the sealing portion 33 due to contact of the high-tension cords 7 with the upper face portion of the partition wall 21 resulting from vibrations of the engine can be prevented. The cam shaft covers 20′ are coupled, at a ventilation portion therebetween, with each other. As shown in FIG. 4, a distributor 34 is provided at one end of the head cover 20, while a pair of pulleys 23 coupled with the cam shafts 22, respectively are provided at the other end of the head cover 20. Belts (not shown) are, respectively, trained over the pulleys 23 so as to be enclosed by a belt cover 24. A side wall of the chamber 8 is formed at the other end of the head cover 20 through utilization of the above described coupling portion of the cam shaft covers 20′.

Meanwhile, a plurality of bosses 25 are formed on the partition wall 21 so as to confront the spark plugs 4, respectively. A through-hole 26 for passing the high-tension cord 7 therethrough is formed on each of the bosses 25 in alignment with the plug hole 6. A plurality of, for example, two first mounting bosses 27 for mounting a side member 30 thereon extend from the partition wall 21. A plurality of, for example, six second mounting bosses 28 for mounting an upper member 31 thereon by using stud bolts 29 are integrally formed with an outer peripheral face of the head cover 20. The high-tension cord 7 is provided with a sealing portion 33 such that the sealing portion 33 is fitted into the through-hole 26. In addition to sealing action of the sealing portion 33 of the high-tension cord 7, since the head cover 20 is attached, through packings 32, to the cylinder head 1, the lower chamber 8″ is completely sealed.

Figure 5:
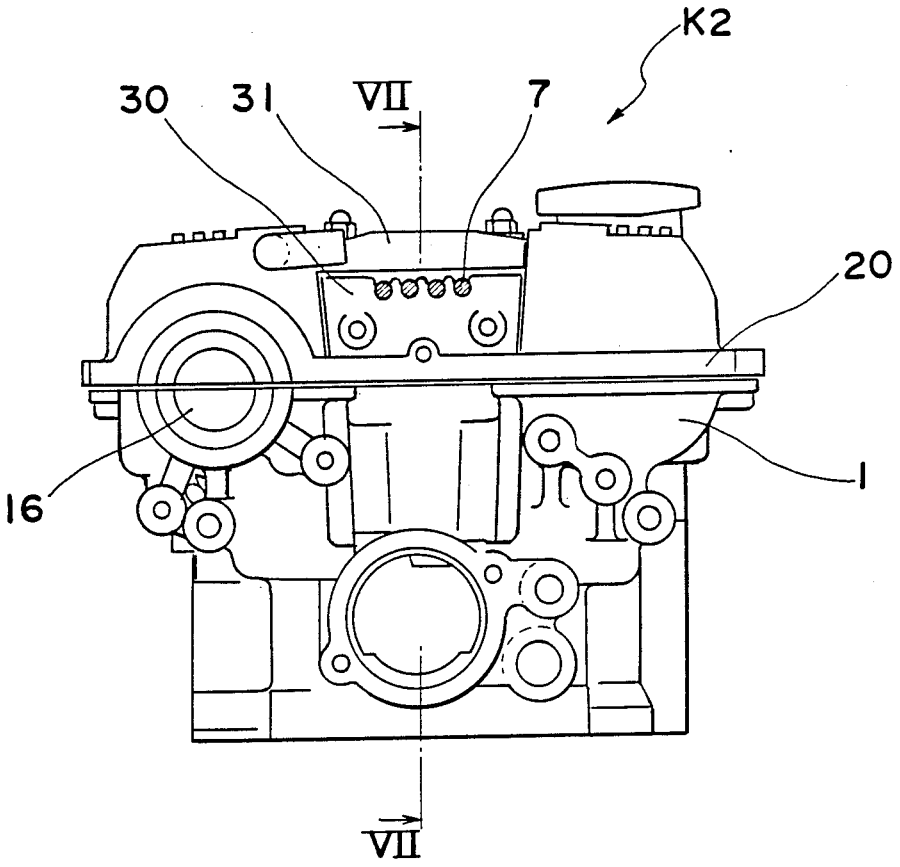

The cylinder head 1 is formed with a plurality of plug bosses 35 each having the plug hole 6 at the center of the combustion chamber 5. A pair of bearing portions 36 for supporting one of the cam shafts 22 are provided, at one side of the cylinder head 1, at opposite end portions of the cylinder head 1. Likewise, another pair of the bearing portions 36 for supporting the other one of the cam shafts 22 are provided, at the other side of the cylinder head 1, at opposite end portions of the cylinder head 1. A bearing cap 37 is mounted on each of the bearing portions 36 such that each of the cam shafts 22 are clamped between the bearing cap 37 and each of the bearing portions 36. As shown in FIG. 5, a tappet 38 and an intake valve 39 are provided between one of a pair of the cam shafts 22 and the combustion chamber 5, while another tappet 38 and an exhaust valve 40 are provided between the other one of the cam shafts 22 and the combustion chamber 5. A pair of oil passages 41 are formed adjacent to a pair of the tappets 38, respectively such that oil in the oil passages 41 lubricates the tappets 38. The intake valve 39 is surrounded by water jackets 42. Similarly, the exhaust valve 40 is surrounded by water jackets 42. The intake valve 39 and the exhaust valve 40 are, respectively, connected with an intake passage 43 and an exhaust passage 44. The chamber 8 is defined between the cam shafts 22 and above the plug bosses 35 and is divided into the upper chamber 8′ and the lower chamber 8″ by the partition wall 21.

The upper member 31 is made of light alloys such as aluminium alloy and is a platelike member mounted between the cam shaft covers 20′ so as to extend in the axial direction of the cam shafts 22. The upper member 31 constitutes a top wall of the chamber 8. The stud bolts 29 screwed into the second mounting bosses 28 are inserted through holes of the upper member 31 such that the upper member 31 is clamped from above by nuts 50 engaged with the stud bolts 29, respectively. The upper member 31 has an L-shaped end portion 31*a* bent downwardly at the one end of the head cover 20 adjacent to the distributor 34 such that the end portion 31*a* is butted against an upper edge of the side member 30.

Figure 6:
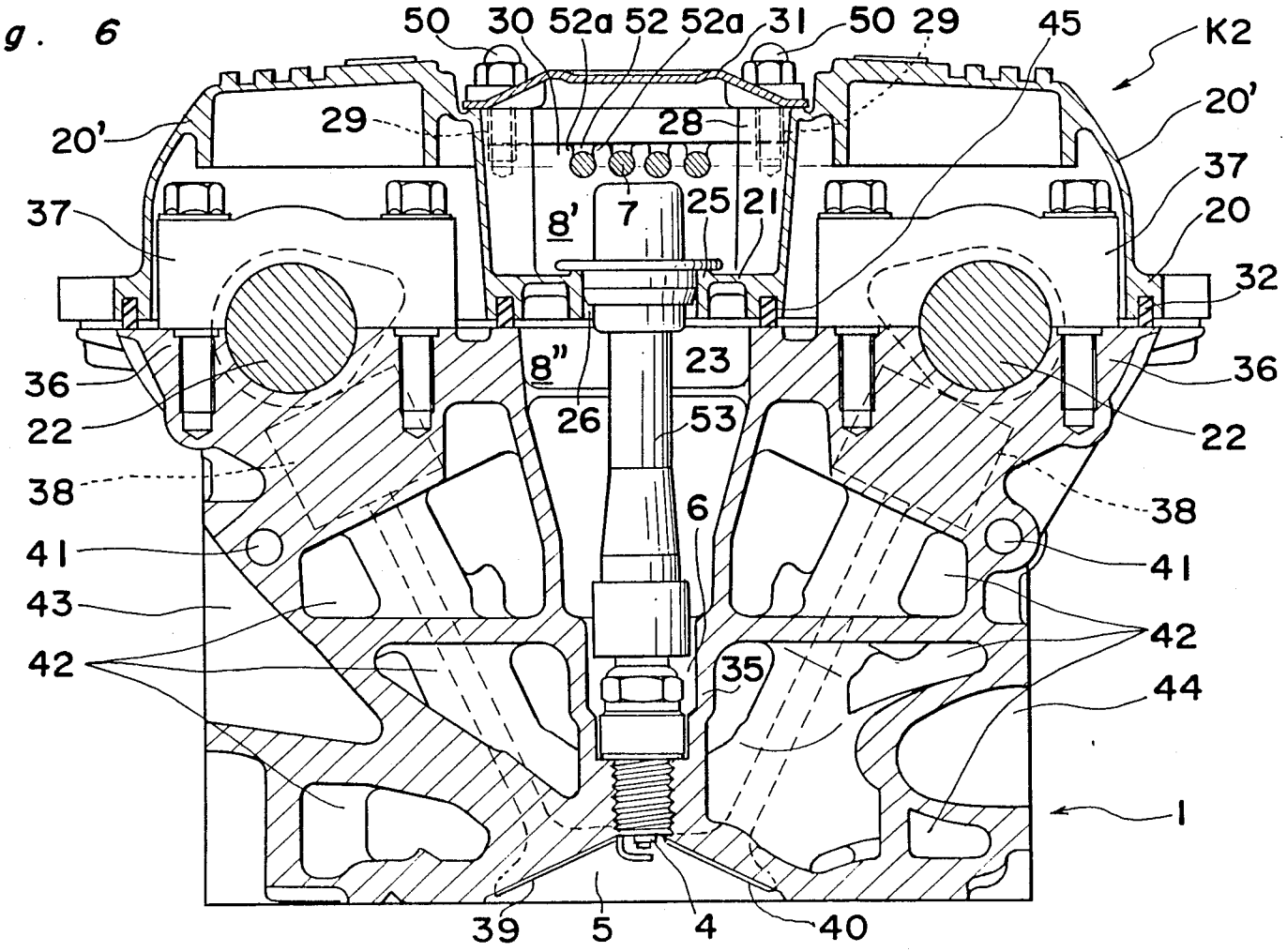
FIG. 6 is a sectional view taken along the line VI—VI in FIG. 4.
Figure 7:
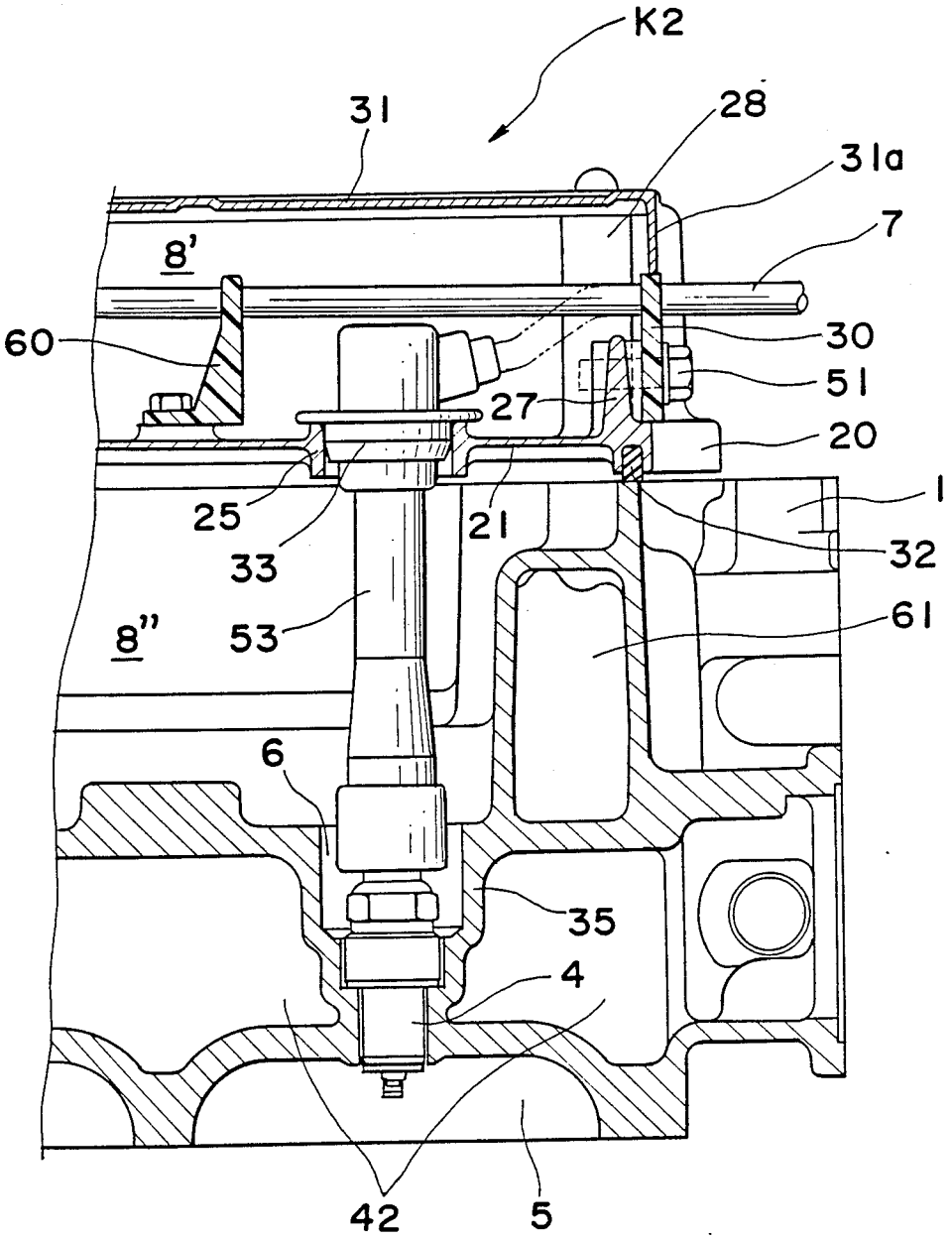
FIG. 7 is a sectional view taken along the line VII—VII in FIG. 5.

Meanwhile, the side member 30 is made of synthetic resin and is secured by bolts 51 to the first mounting bosses 27 provided at the one end of the head cover 20 so as to be disposed below a lower edge of the end portion 31*a*. A plurality of recesses 52 for securing therein the high-tension cords 7, respectively are formed at a predetermined interval on the upper edge of the side member 30. As shown in FIG. 6, in order to prevent electrical leak of the high-tension cords 7 through contact of the high-tension cords 7 with the upper member 31 made of metals, each of the recesses 52 has opposed lip portions 52*a* formed at its inlet such that each of the high-tension cords 7 is securely retained in each of the recesses 52 by the lip portions 52*a*. Furthermore, each of the recesses 52 is so formed as to have a depth larger than a diameter of each of the high-tension cords 7 such that each of the high-tension cords 7 fitted into the recesses 52, respectively is disposed slightly below the upper edge of the side member 30. It can also be so arranged that only a portion of the side member 30, which is disposed peripherally of the recesses 52, is made of insulating material softer than steel. Thus, the high-tension cords 7 are electrically insulated by the side member 30 and electrical leak of the high-tension cords 7 due to wear of the high-tension cords 7 can be prevented.

Each of the high-tension cords 7 has a reinforced portion 53 extending from a rear end of each of the spark plugs 4 to the sealing portion 33 such that the reinforced portion 53 is not readily bent through its contact with each of the bosses 25. Since the reinforced portion 53 extends from the rear end of each of the spark plugs 4 to the sealing portion 33, each of the high-tension cords 7 can be easily fitted into or drawn from the through-hole 26 from above the partition wall 21. In order to tightly seal the through-hole 26, the sealing portion 33 fitted into the through-hole 26 is made of rubber. Since the sealing portion 33 is securely retained in the through-hole 26, the through-hole 26 is tightly sealed and vibrations of the high-tension cords 7 leading to the wear, etc. can be obviated.

Furthermore, a support member 60 for supporting the high-tension cords 7 in the upper chamber 8′ is provided in the head cover arrangement K2. The support member 60 is made of synthetic resin and is properly attached to the partition wall 21 so as to prevent the high-tension cords 7 from not only being brought into contact with the neighboring elements made of metals but also being vibrated. Since the high-tension cords 7 are secured in the upper chamber 8′ by the support member 60, contact of the high-tension cords 7 with the peripheral walls and wear of the sealing portion 33 due to vibrations of the engine can be eliminated, so that electrical leak from the high-tension cords 7 can be prevented and the through-hole 26 can be tightly sealed by the sealing portion 33. Moreover, the opening 16 for securing therein the distributor 34 is formed, at the one end of the head cover 20 adjacent to the side member 30, on the head cover 20 and an upper end portion of the cylinder head 1 and is brought into alignement with one of the cam shafts 22 so as to be driven by the one of the cam shafts 22. Thus, since the outlets 52 of the high-tension cords 7 are disposed adjacent to the distributor 34, the high-tension cords 7 can be directly connected with the distributor 34 without the need for providing a support member for the high-tension cords 7 and electrical leak from the high-tension cords 7 can be prevented in the compact wiring of the high-tension cords 7. Meanwhile, a reference numeral 61 denotes a blowby passage for passing blowby gas therethrough. The blowby passage 61 is communicated with chambers in the cam shaft covers 20'.

By the above described arrangement of the head cover arrangement K2, the head cover arrangement K2 is assembled as follows. Initially, the head cover 20 is mounted on the cylinder head 1 through the packings 32. Then, the side member 30 is attached to the first mounting bosses 27 of the head cover 20 by using the bolts 51. Subsequently, the high-tension cords 7 are secured in the recesses 52 of the side member 30 and finally, the upper member 31 is attached to the second mounting bosses 28 of the head cover 20 by using the stud bolts 29 and the nuts 50.

In the head cover arrangement K2, since the plug hole 6 is securely sealed against rain water, dust, etc. by the partition wall 21 for dividing the chamber 8 into the upper chamber 8' and the lower chamber 8" and sealing action of the sealing portion 33 of each of the high-tension cords 7 relative to the through-hole 26 of the partition wall 21, it becomes possible to prevent penetration of rain water, dust, etc. into the plug hole 6 completely.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. In a head cover arrangement for a double overhead cam type engine, including a head cover for covering two cam shafts provided, in parallel to each other, on a cylinder head such that a plurality of spark plugs are provided in a hollow defined, between said cam shafts, by an outer peripheral face of said head cover and an outer peripheral face of said cylinder head, the improvement comprising:

a boundary member for bounding the hollow so as to form a chamber for accommodating therein said spark plugs and a plurality of high-tension cords connected to said spark plugs, respectively; and a partition wall for dividing the chamber into an upper chamber and a lower chamber;

said boundary member including an upper member and a side member;

said upper member being mounted on said head cover and extending in an axial direction of said cam shafts so as to constitute a top wall of the chamber;

said side member being provided at one end of said upper member in the axial direction of said cam shafts so as to constitute a side wall of the chamber and being formed, at its edge portion abutting on said upper member, with a plurality of recesses for securing therein said high-tension cords, respectively such that said high-tension cords are drawn out of the chamber through the recesses, respectively, said partition wall being formed, at its positions aligned with said spark plugs provided in the hollow, with a plurality of bosses, said bosses each having a through-hole for passing each of said high-tension cords therethrough, said high-tension cords each having a sealing portion fitted into the through-hole such that the through-hole is sealed by said sealing portion.

2. A head cover arrangement as claimed in claim 1 wherein at least one of said head cover and said cylinder head is formed, at its one end adjacent to said side member, with an opening for mounting therein a distributor driven by one of said cam shafts.

3. A head cover arrangement as claimed in claim 2, wherein a portion of said side member, which is disposed peripherally of the recesses, is made of insulating material softer than steel.

4. A head cover arrangement as claimed in claim 1, further including a support member for securing in position said high-tension cords accommodated in the upper chamber, said partition wall being made, at its upper face portion, of insulating material softer than steel.

5. A head cover arrangement as claimed in claim 1, wherein a plurality of cam shaft covers for covering said cam shafts are coupled with each other into said head cover and said partition wall is integrally formed with said head cover, said partition wall being formed, at its peripheral portion confronting said cylinder head, with a seal portion, said high-tension cords each having a reinforced portion extending from said sealing portion to a rear end portion of each of said spark plugs such that rigidity of each of said high-tension cords is increased by said reinforced portion.

6. A head cover arrangement as claimed in claim 5, wherein said head cover is made of a light metal.

7. A head cover arrangement as claimed in claim 6, wherein a portion of said side member, which is disposed peripherally of the recesses, is made of insulating material softer than steel.

8. A head cover arrangement as claimed in claim 1, wherein said head cover includes mounting bosses at one end thereof and said side member is secured by bolts to said mounting bosses.

9. A head cover arrangement as claimed in claim 1, wherein each of said recesses extends from an upper edge of said side member, each of said recesses being formed so as to have a depth larger than a diameter of each of said high-tension cords such that each of said high-tension cords fitted into said recesses is disposed slightly below said upper edge of said side member.

10. In a head cover arrangement for a double overhead cam type engine, including a head cover for covering two cam shafts provided, in parallel with each other, on a cylinder head such that a plurality of spark plugs are provided in a hollow defined, between said cam shafts, by an outer peripheral face of said head cover and an outer peripheral face of said cylinder head, the improvement comprising:

a boundary member for bounding the hollow so as to form a chamber for accommodating therein said spark plugs and a plurality of high-tension cords connected to said spark plugs, respectively;

said boundary member being formed with a plurality of through-holes for securing therein said high-tension cords, respectively such that said high-tension cords are drawn out of the chamber through the through-holes, respectively;

the through-holes and said high-tension cords constituting a first sealing portion for sealing the chamber; and a partition wall for dividing the chamber into an upper chamber for accommodating therein at least said high-tension cords and a lower chamber for accommodating therein said spark plugs;

said partition wall being formed with a plurality of through-bores for guiding said high-tension cords from the upper chamber to the lower chamber such that the through-bores and said high-tension cords constitute a second sealing portion.

11. A head cover arrangement as claimed in claim 10, further including a support member for securing in position said high-tension cords accommodated in the upper chamber, said partition wall being made, at its upper face portion, of insulating material softer than steel.

12. A head cover arrangement as claimed in claim 10, wherein said boundary member includes an upper member and a side member, said upper member being mounted on said head cover and extending in an axial direction of said cam shafts so as to constitute a top wall of the chamber;

said side member being provided at one end of said upper member in the axial direction of said cam shafts so as to constitute a side wall of the chamber and being formed, at its edge portion abutting on said upper member, with a plurality of recesses acting as the through-holes, respectively.

13. A head cover arrangement as claimed in claim 12, wherein at least one of said head cover and said cylinder head is formed, at its one end adjacent to said side member, with an opening for mounting therein a distributor.

14. A head cover arrangement as claimed in claim 12, further including a sealing member provided at a periphery of said partition wall such that said partition wall is brought into contact, through said sealing member, with said cylinder head, said high-tension cords each being provided, at its portion engageable with each of the through-bores, with a sealing portion;

said sealing portion being tightly fitted into each of said through-bores so as to secure each of said high-tension cords and seal each of the through-bores.

15. A head cover arrangement as claimed in claim 14, wherein a plurality of cam shaft covers for covering said cam shafts are coupled with each other into said head cover and said partition wall is integrally formed with said head cover, said high-tension cords each having a reinforced portion extending from said sealing portion to a rear end portion of each of said spark plugs such that rigidity of each of said high-tension cords is increased by said reinforced portion.

* * * * *